US011217420B2

(12) United States Patent
Ito

(10) Patent No.: US 11,217,420 B2
(45) Date of Patent: Jan. 4, 2022

(54) X-RAY TUBE

(71) Applicant: CANON ELECTRON TUBES & DEVICES CO., LTD., Otawara (JP)

(72) Inventor: Takayuki Ito, Nasushiobara (JP)

(73) Assignee: CANON ELECTRON TUBES & DEVICES CO., LTD., Otawara (JP)

( * ) Notice: Subject to any disclaimer, the term of this patent is extended or adjusted under 35 U.S.C. 154(b) by 0 days.

(21) Appl. No.: 16/775,361

(22) Filed: Jan. 29, 2020

(65) Prior Publication Data

US 2020/0185184 A1 Jun. 11, 2020

Related U.S. Application Data

(63) Continuation of application No. PCT/JP2018/013890, filed on Mar. 30, 2018.

(30) Foreign Application Priority Data

Aug. 14, 2017 (JP) ..... JP2017-156612

(51) Int. Cl.
*H01J 35/06* (2006.01)
*H01J 35/14* (2006.01)
*H01J 35/16* (2006.01)

(52) U.S. Cl.
CPC ..... *H01J 35/066* (2019.05); *H01J 35/064* (2019.05); *H01J 35/14* (2013.01); *H01J 35/16* (2013.01)

(58) Field of Classification Search
CPC ..... H01J 35/06; H01J 35/14; H01J 2235/06; H01J 35/066; H01J 35/10; H01J 35/16; H01J 2235/068; H01J 35/064
See application file for complete search history.

(56) References Cited

U.S. PATENT DOCUMENTS 2,121,631 A * 6/1938 Atlee ..... H01J 35/26 378/134
3,783,333 A 1/1974 Atlee
(Continued)

FOREIGN PATENT DOCUMENTS

EP 3 474 306 A1 4/2019
JP 49-78494 7/1974
(Continued)

OTHER PUBLICATIONS

International Search Report dated Apr. 24, 2018 in PCT/JP2018/013890 filed Mar. 30, 2018, 2 pages.
(Continued)

*Primary Examiner* — Chih-Cheng Kao
(74) *Attorney, Agent, or Firm* — Oblon, McClelland, Maier & Neustadt, L.L.P.

(57) ABSTRACT

According to one embodiment, an X-ray tube includes an anode including a target surface, and a cathode including a first filament and a focusing electrode. The focusing electrode includes a valley bottom portion, a first inclined plane sloping up from the valley bottom portion in a direction of the anode, a first focusing groove, and a first storage groove. θ1 is greater than 0°. The first focusing groove has a longitudinal axis. One end portion on the first extension line side of the first focusing groove is closer to a first reference surface than the other end portion of the first focusing groove.

7 Claims, 11 Drawing Sheets

(56) References Cited

U.S. PATENT DOCUMENTS

| | | | | |
|---|---|---|---|---|
| 4,685,118 | A * | 8/1987 | Furbee | H01J 35/14 378/114 |
| 4,823,371 | A | 4/1989 | Grady | |
| 6,256,375 | B1 | 7/2001 | Lu et al. | |
| 10,872,741 | B2 * | 12/2020 | Shimono | H01J 35/14 |
| 2019/0180970 | A1 * | 6/2019 | Shimono | H01J 35/064 |

FOREIGN PATENT DOCUMENTS

| | | | | |
|---|---|---|---|---|
| JP | 5-121020 | A | 5/1993 | |
| JP | 2017-228355 | A | 12/2017 | |
| WO | WO 2017/073523 | A1 | 5/2017 | |
| WO | WO-2017221743 | A1 * | 12/2017 | H01J 35/066 |

OTHER PUBLICATIONS

Extended European Search Report dated Feb. 8, 2021 in European Patent Application No. 18846155.2, 8 pages.

* cited by examiner

X-RAY TUBE

CROSS-REFERENCE TO RELATED APPLICATIONS

This application is a Continuation Application of PCT Application No. PCT/JP2018/013890, filed Mar. 30, 2018 and based upon and claiming the benefit of priority from Japanese Patent Application No. 2017-156612, filed Aug. 14, 2017, the entire contents of all of which are incorporated herein by reference.

FIELD

Embodiments described herein relate generally to an X-ray tube.

BACKGROUND

In general, X-ray tubes are used for image diagnosis, etc. A cathode of such an X-ray tube comprises two electron guns. Each of the electron guns comprises a filament coil which emits electrons and a focusing groove which focuses the emitted electrons. The two electron guns share one focusing electrode. The electrons that have been emitted from each of the electron guns and have been focused collide with a target surface of an anode target, and focuses are thereby formed on the target surface. The two electron guns are located with the focuses sandwiched therebetween and are each inclined so that the focuses can be formed at the same position on the target surface.

The target surface is inclined at an angle referred to as a target angle in a main emission direction. In a direction orthogonal to both the main emission direction and the axis of the X-ray tube, the target surface and surfaces opposite to the target surface of the electron guns are inclined approximately at the target angle. Because the flight distance of electrons emitted from one end and that of electrons emitted from the other end of both the ends in a longitudinal direction of the filament coil are different, the focuses have distorted shapes. Thus, in order to correct such distortion of the shapes of the focuses, a technique of inclining the whole electron guns at a proper angle with respect to the main emission direction has been known.

DETAILED DESCRIPTION

Figure 1:
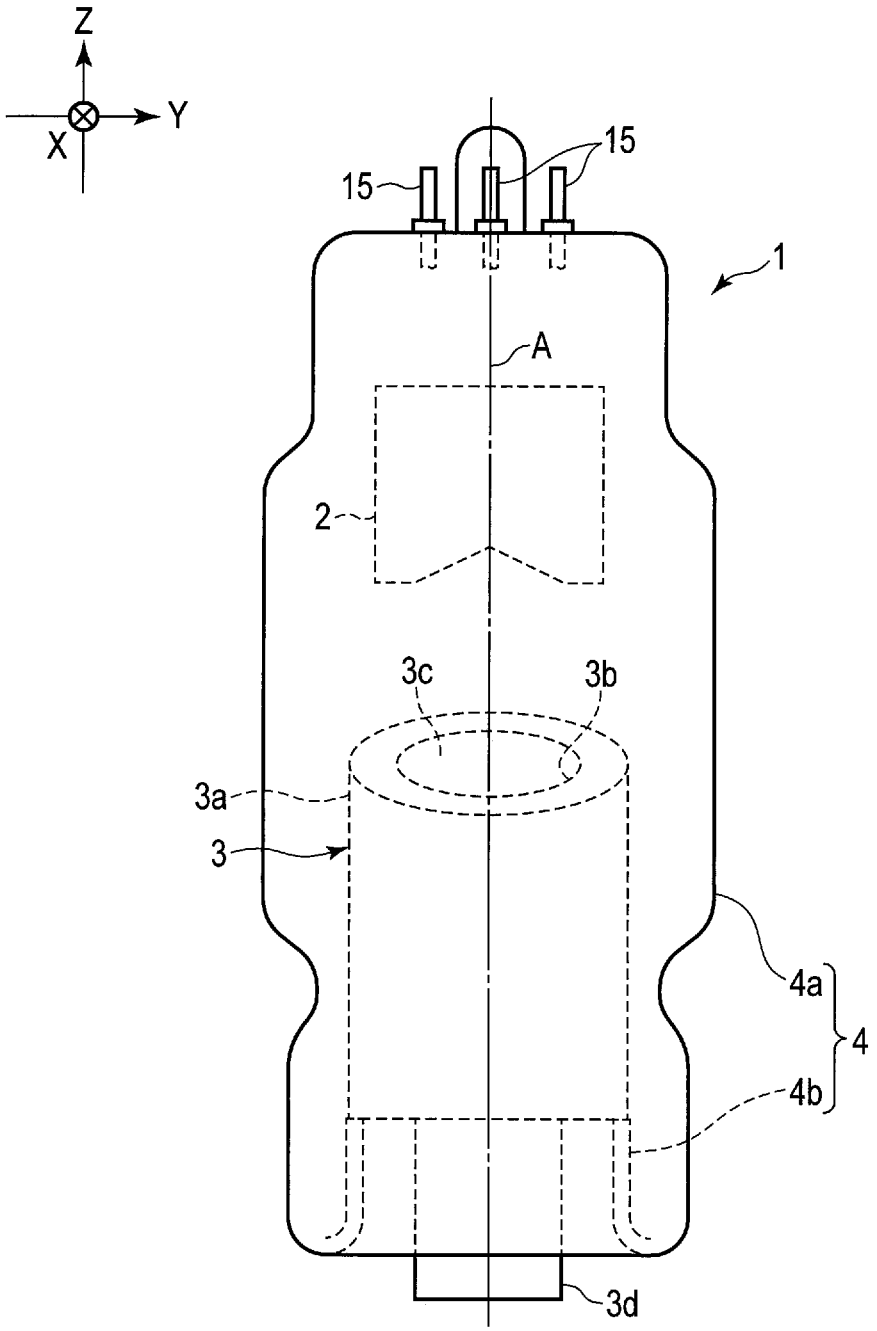
FIG. 1 is a schematic structural view showing an X-ray tube according to one embodiment.

In general, according to one embodiment, there is provided an X-ray tube comprising: an anode comprising a target surface which emits an X-ray in a main emission direction from a first focus formed by collision of an electron beam; and a cathode disposed opposite the target surface of the anode, the cathode comprising a first filament which emits the electron beam and a focusing electrode which focuses the electron beam emitted from the first filament, the focusing electrode including a valley bottom portion located farthest from the first focus, a first inclined plane sloping up from the valley bottom portion in a direction of the anode, a first focusing groove opening in the first inclined plane, and a first storage groove opening in a bottom surface of the first focusing groove and storing the first filament. When an axis passing through a center of the first focus and parallel to an axis of the X-ray tube is a reference axis, a plane including the reference axis and the main emission direction is a first reference surface, and a first angle formed by a first extension line and a second extension line crossing each other on an opposite side to a side to which the X-ray is emitted with respect to the reference axis is $\theta 1$, the first extension line being a virtual straight line extending from a boundary between the valley bottom portion and the first inclined plane along the first reference surface, the second extension line being a virtual straight line extending from the target surface along the first reference surface and the target surface. $\theta 1>0°$. The first focusing groove has a longitudinal axis. One end portion on the first extension line side of the first focusing groove is closer to the first reference surface than another end portion of the first focusing groove.

One embodiment of the present invention will be described hereinafter with reference to the drawings. The disclosure is merely an example, and proper changes within the spirit of the invention, which are easily conceivable by a person having ordinary skill in the art, are included in the scope of the present invention as a matter of course. In addition, in some cases, in order to make the description clearer, the width, the thickness, the shape, etc., of each part are schematically illustrated in the drawings, compared to those in reality. However, the schematic illustration is merely an example, and does not limit the interpretation of the present invention. Further, in the present specification and each figure, the same elements as those described in connection with preceding figures are given the same reference numbers, and a detailed description thereof may be omitted as appropriate.

FIG. 1 is a schematic structural view showing an X-ray tube 1 according to one embodiment.

As shown in FIG. 1, the X-ray tube 1 comprises a cathode 2, an anode 3, a vacuum envelope 4, and pin assemblies 15. The cathode 2 comprises a filament (electron emission source) which emits electrons and a focusing electrode. In the present embodiment, the cathode 2 comprises a first filament and a second filament. The pin assemblies 15 comprise, at least, two pin assemblies 15 for applying a negative high voltage and a filament current to the first filament, two pin assemblies 15 for applying a negative high voltage and a filament current to the second filament, and one pin assembly 15 for applying a negative high voltage to the focusing electrode. In addition, the pin assemblies 15 for the focusing electrode also have the function of supporting the focusing electrode and fixing the focusing electrode.

The anode 3 comprises a target main body 3*a* and an anode extending portion 3*d* connected to the target main body 3*a*. The target main body 3*a* comprises a target layer 3*b* with which electrons collide. A surface with which electrons collide of the target layer 3*b* is a target surface 3*c*. The target main body 3*a* is formed of a metal having high thermal conductivity, such as molybdenum (Mo), copper (Cu), or an alloy thereof. The target layer 3*b* is formed of a metal whose melting point is higher than that of a material used for the target main body 3*a*. For example, the target main body 3*a* is formed of copper or a copper alloy, and the target layer 3*b* is formed of a tungsten alloy. The anode extending portion 3*d* is formed in a columnar shape, and copper or a copper alloy is used. The anode extending portion 3*d* fixes the target main body 3*a*. Electrons that have been emitted from the above filaments and have been focused by the focusing electrode collide with the target surface 3*c*, and the anode 3 thereby emits X-rays.

The vacuum envelope 4 comprises a glass container 4*a* and a metal container 4*b*. The metal container 4*b* is airtightly connected to the glass container 4*a* on one side, and airtightly connected to the anode 3 on the other side. The glass container 4*a* is formed of, for example, boron silicon glass. The glass container 4*a* can be formed by, for example, airtightly joining glass members together by melting them. Because the glass container 4*a* has an X-ray transmitting property, X-rays emitted from the anode 3 are transmitted through the glass container 4*a* and emitted to the outside of the vacuum envelope 4. The metal container 4*b* is airtightly fixed to at least one of the target main body 3*a* and the anode extending portion 3*d*. Here, the metal container 4*b* is airtightly connected to the target main body 3*a* by brazing. In addition, the metal container 4*b* and the glass container 4*a* are airtightly connected by sealing. In the present embodiment, the metal container 4*b* is formed in an annular shape. In addition, the metal container 4*b* is formed of Kovar.

The vacuum envelope 4 is formed so as to store the cathode 2 and the target main body 3*a* and expose the anode extending portion 3*d*. To the vacuum envelope 4, the pin assemblies 15 are airtightly attached. Each of the pin assemblies 15 comprises a cathode pin, etc., and is located inside and outside the vacuum envelope 4.

Further, a Z-axis is an axis parallel to an X-ray tube axis A, an X-axis is an axis orthogonal to the Z-axis, and a Y-axis is an axis orthogonal to both the X-axis and the Z-axis. A main emission direction d of X-rays, which will be described later, is parallel to the X-axis.

A voltage and a current output from a power supply unit outside the X-ray tube 1 are applied to the pin assemblies 15 for the filaments, and further applied to the filaments. The filaments thereby emit electrons (thermoelectrons). The above power supply unit applies a predetermined voltage also to the cathode 2 and the anode 3. In the present embodiment, a negative high voltage is applied to the cathode 2, and a positive high voltage is applied to the anode 3. Because an X-ray tube voltage (tube voltage) is applied between the anode 3 and the cathode 2, electrons emitted from the filaments are accelerated and incident on the target surface 3*c* as electron beams. That is, an X-ray tube current (tube current) flows from the cathode 2 to a focus on the target surface 3*c*.

The focusing electrode, which has a cathode potential, can focus electron beams (electrons) travelling from the filaments toward the anode 3.

The target surface 3*c* emits X-rays when electron beams are incident thereon, and X-rays emitted from the focus are transmitted through the vacuum envelope 4 and emitted to the outside of the X-ray tube 1.

Figure 2:
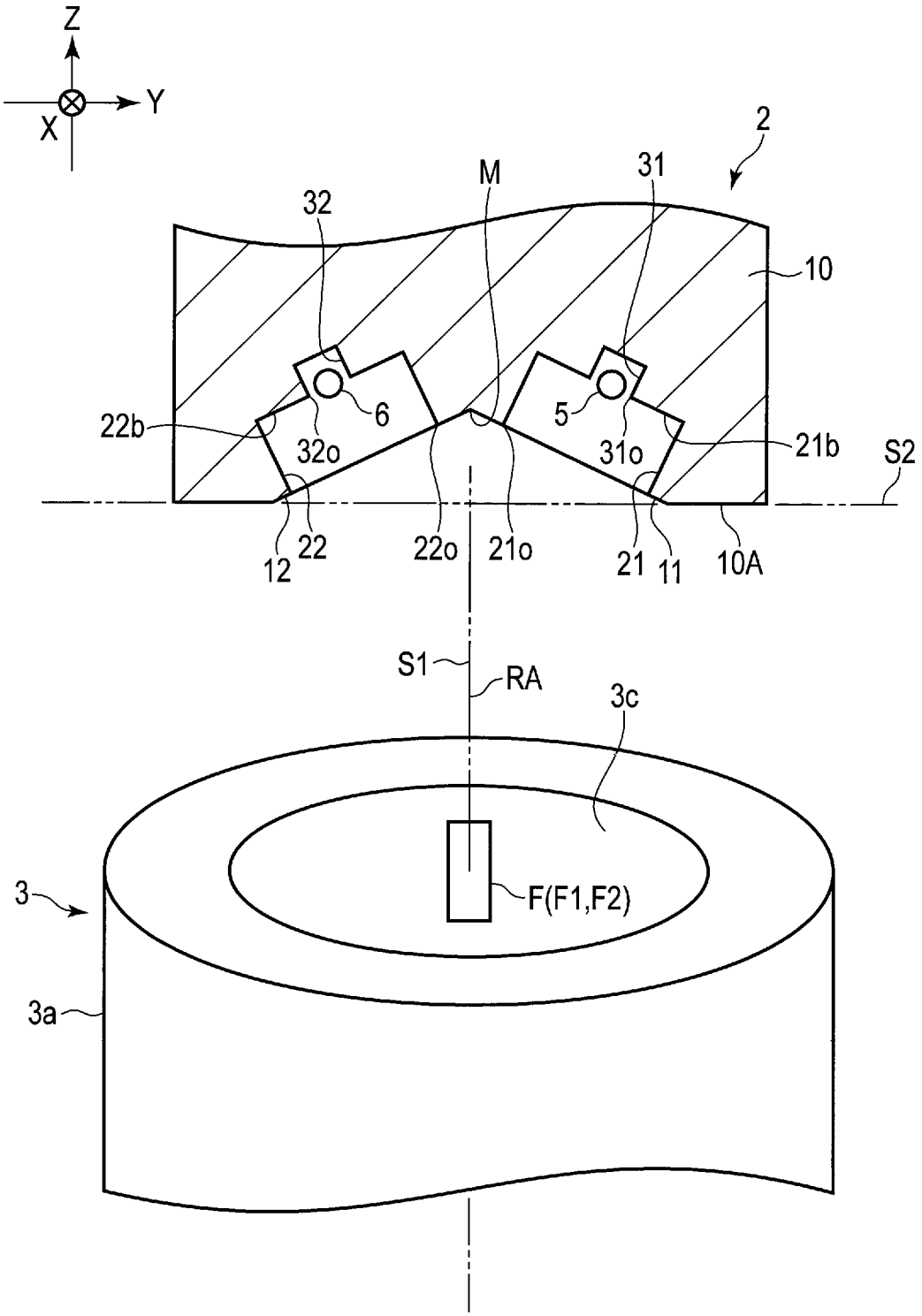
FIG. 2 is an enlarged view showing a cathode and an anode shown in FIG. 1.

FIG. 2 is an enlarged view showing the cathode 2 and the anode 3 shown in FIG. 1. FIG. 2 shows a cross-sectional shape of the cathode 2 along a Y-Z plane passing through a reference axis RA, which will be described later, and shows the anode 3 as seen from the front.

As shown in FIG. 2, the cathode 2 comprises a filament coil 5 as the first filament which emits electrons, a filament coil 6 as the second filament which emits electrons, and a focusing electrode 10 which focuses electrons emitted from the filament coil 5 and the filament coil 6. The focusing electrode 10 includes a flat front surface 10A, a first inclined plane 11, a first focusing groove 21, a first storage groove 31, a second inclined plane 12, a second focusing groove 22, and a second storage groove 32. If the boundary between the first inclined plane 11 and the second inclined plane 12 is referred to as a valley bottom portion, the first inclined plane 11 and the second inclined plane 12 each slope up from the valley bottom portion M in the direction of the anode 3. The valley bottom portion M is a segment parallel to a first reference surface S1, which will be described later.

The front surface 10A is the closest to the anode 3 in the cathode 2 (focusing electrode 10). In the present embodiment, the front surface 10A is parallel to an X-Y plane. It should be noted that the front surface 10A and the valley bottom portion M may not be parallel to the X-Y plane. In order that two electron guns can form focuses F at the same position, the first inclined plane 11 and the second inclined plane 12 are inclined with respect to the X-Y plane. The valley bottom portion M is located in an X-Z plane passing through the reference axis RA.

The distance to the valley bottom portion M is the longest of the distances from the focuses F to the first inclined plane 11 and the second inclined plane 12.

The first focusing groove 21 opens in the first inclined plane 11. The first storage groove 31 opens in a bottom surface 21*b* of the first focusing groove 21, and stores the filament coil 5. The second focusing groove 22 opens in the second inclined plane 12. The second storage groove 32 opens in a bottom surface 22*b* of the second focusing groove 22, and stores the filament coil 6.

The first inclined plane 11 is parallel to the bottom surface 21*b*, and the second inclined plane 12 is parallel to the bottom surface 22*b*. Thus, an opening 31*o* of the first storage groove 31 is parallel to an opening 21*o* of the first focusing groove 21, and an opening 32*o* of the second storage groove 32 is parallel to an opening 22*o* of the second focusing groove 22. In other words, the bottom surface 21*b* is parallel to the first inclined plane 11, and the bottom surface 22*b* is parallel to the second inclined plane 12. The filament coil 5 extends along a virtual plane parallel to the opening 31*o*. The filament coil 6 extends along a virtual plane parallel to the opening 32*o*.

Of the focuses F formed on the target surface 3*c*, a focus from which X-rays are emitted in the main emission direction when electrons emitted from the filament coil 5 are incident on the target surface 3*c* is referred to as a first focus F1. On the other hand, a focus from which X-rays are emitted in the main emission direction when electrons emitted from the filament coil 6 are incident on the target surface 3*c* is referred to as a second focus F2. In the present embodiment, the central position of the first focus F1 and the central position of the second focus F2 are identical. It should be noted that the dimensions of the first focus F1 and the dimensions of the second focus F2 are different. This is because the two electron guns have different structures in the present embodiment. For example, the dimensions of the filament coil 5 and the dimensions of the filament coil 6 are different, which will be described later.

Here, the above reference axis RA is an axis which passes through the center of the first focus F1 and which is parallel to the X-ray tube axis A. In the present embodiment, since the central positions of the first focus F1 and the second focus F2 are identical, the reference axis RA is also an axis which passes through the center of the second focus F2 and which is parallel to the X-ray tube axis A. In addition, a plane including the reference axis RA and the main emission direction is referred to as the first reference surface S1. A virtual plane located in the same plane as the front surface 10A is referred to as a second reference surface S2.

Figure 3:
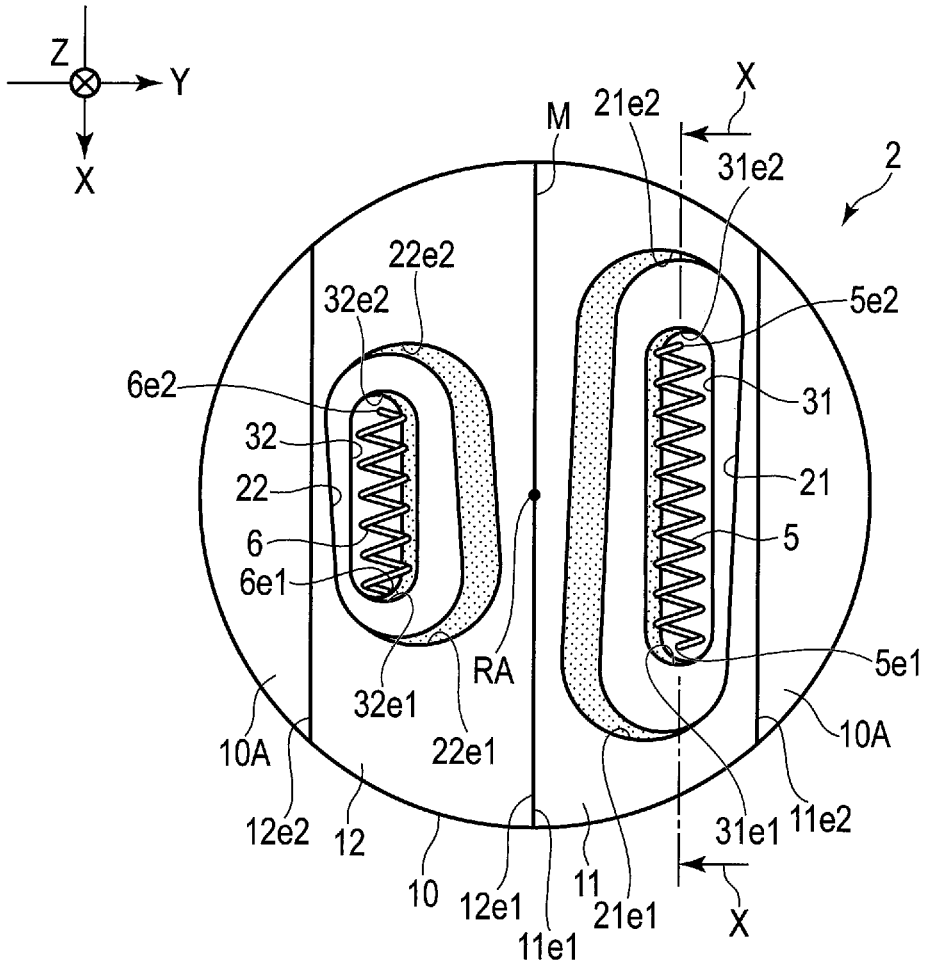
FIG. 3 is a plan view showing the cathode shown in FIG. 2.

FIG. 3 is a plan view showing the cathode 2 shown in FIG. 2, and is an X-Y plane view showing the cathode 2 as seen from the anode 3 side.

As shown in FIG. 3 and FIG. 2, the first inclined plane 11 comprises a first edge 11*e*1 located on the valley bottom portion M side and a second edge 11*e*2 located on the opposite side to the valley bottom portion M. The first inclined plane 11 is uniformly inclined from the first edge 11*e*1 toward the second edge 11*e*2. Similarly, the second inclined plane 12 comprises a first edge 12*e*1 located on the valley bottom portion M side and a second edge 12*e*2 located on the opposite side to the valley bottom portion M. The second inclined plane 12 is uniformly inclined from the first edge 12*e*1 toward the second edge 12*e*2.

As shown in FIG. 3, each of the first focusing groove 21, the second focusing groove 22, the first storage groove 31, and the second storage groove 32 has a longitudinal axis. In addition, each of the filament coil 5 and the filament coil 6 is formed to extend linearly, and has a longitudinal axis. The respective longitudinal axes of the first storage groove 31 and the filament coil 5 are orthogonal to the reference axis RA and parallel to the first reference surface S1. Similarly, the respective longitudinal axes of the second storage groove 32 and the filament coil 6 are orthogonal to the reference axis RA, and parallel to the first reference surface S1.

In the present embodiment, the respective longitudinal axes of the first focusing groove 21 and the second focusing groove 22 are not parallel to the first reference surface S1.

Here, the first focusing groove 21 comprises one end portion 21*e*1 and the other end portion 21*e*2. The first storage groove 31 comprises one end portion 31*e*1 and the other end portion 31*e*2. The filament coil 5 comprises one end portion 5*e*1 and the other end portion 5*e*2.

In addition, the second focusing groove 22 comprises one end portion 22*e*1 and the other end portion 22*e*2. The second storage groove 32 comprises one end portion 32*e*1 and the other end portion 32*e*2. The filament coil 6 comprises one end portion 6*e*1 and the other end portion 6*e*2.

Figure 4:
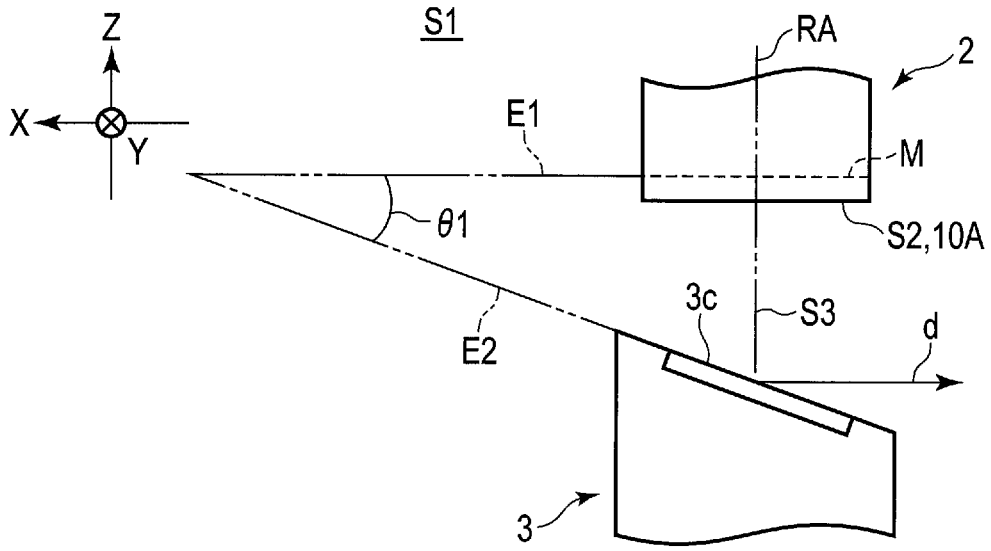
FIG. 4 is a diagram showing the cathode and the anode, and is a diagram for explaining a first angle.

FIG. 4 is a diagram showing the cathode 2 and the anode 3, and is a diagram for explaining a first angle θ1. FIG. 4 shows the cathode 2 as seen from the front, and shows a cross-sectional shape of the anode 3 along the X-Z plane passing through the reference axis RA. In addition, FIG. 4 shows the main emission direction d of X-rays, etc.

The main emission direction d is a direction in the X-Z plane passing through the reference axis RA, and is a direction along the central axis of a used X-ray beam. In the present embodiment, the main emission direction is perpendicular to the reference axis RA. In general, the shape of a focus formed on the target surface 3*c* as seen from the outside of the X-ray tube 1 along the main emission direction d, which passes through the center of the focus and crosses the reference axis RA perpendicularly, is referred to as an effective focus.

As shown in FIG. 4, an angle formed by a first extension line E1 and a second extension line E2 which cross each other on the opposite side to the side to which X-rays are emitted with respect to the reference axis RA is the first angle θ1. The first extension line E1 is a virtual straight line which extends from the valley bottom portion M (or, generally, the boundary between the valley bottom portion M and the first inclined plane 11) along the first reference surface S1. The second extension line E2 is a virtual straight line which extends from the target surface 3*c* along the first reference surface S1 and the target surface 3*c*.

The first angle θ1 is greater than 0° (θ1>0°). In the present embodiment, the first angle θ1 is an acute angle) (0°<θ1<90°). That is, the front surface 10A and the valley bottom portion M are not parallel to the target surface 3*c*.

Here, a plane which includes the reference axis RA and is orthogonal to the first reference surface S1 is referred to as a third reference surface S3.

As shown in FIG. 3 and FIG. 4, because of what have been described above, the one end portion 21*e*1 on the first extension line E1 side of the first focusing groove 21 is closer to the first reference surface S1 than the other end portion 21*e*2 of the first focusing groove 21. Similarly, the one end portion 22*e*1 on the first extension line E1 side of the second focusing groove 22 is closer to the first reference surface S1 than the other end portion 22*e*2 of the second focusing groove 22.

Figure 5:
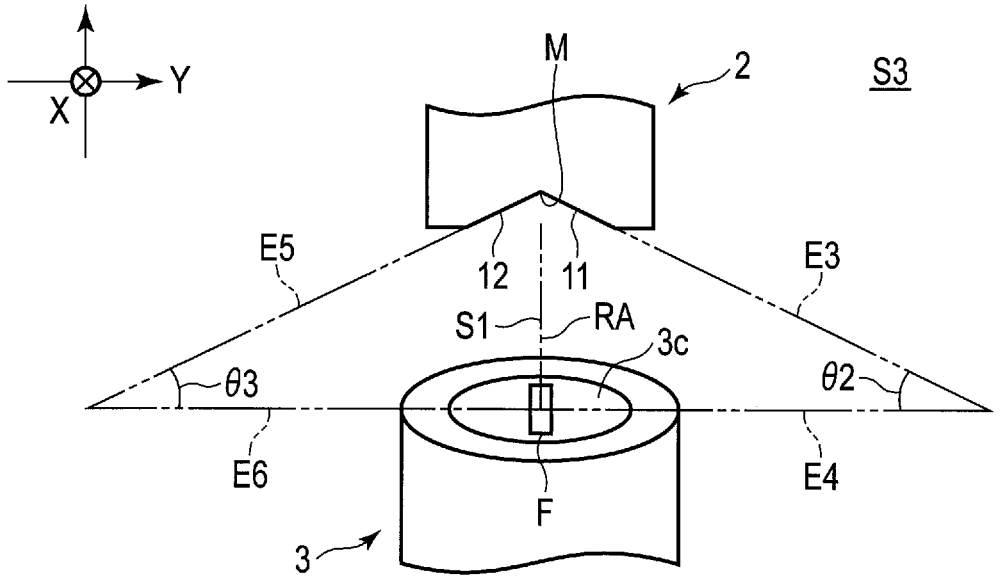
FIG. 5 is a front view showing the cathode and the anode, and is a diagram for explaining a second angle.

FIG. 5 is a front view showing the cathode 2 and the anode 3, and is a diagram for explaining a second angle θ2 and a third angle θ3.

As shown in FIG. 5, in the Y-axis, an angle formed by a third extension line E3 and a fourth extension line E4 which cross each other on the side away from the reference axis RA beyond the cathode 2 and the anode 3 is the second angle θ2. The third extension line E3 is a virtual straight line which extends from the first inclined plane 11 along the third reference surface S3 and the first inclined plane 11. The fourth extension line E4 is a virtual straight line which extends from the target surface 3*c* along the third reference surface S3 and the target surface 3*c*.

The second angle θ2 is greater than 0° (θ2>0°). In the present embodiment, the second angle θ2 is an acute angle (0°<θ2<90°).

Similarly, in the Y-axis, an angle formed by a fifth extension line E5 and a sixth extension line E6 which cross each other on the side away from the reference axis RA beyond the cathode 2 and the anode 3 is the third angle θ3. The fifth extension line E5 is a virtual straight line which extends from the second inclined plane 12 along the third reference surface S3 and the second inclined plane 12. The sixth extension line E6 is a virtual straight line which extends from the target surface 3*c* along the third reference surface S3 and the target surface 3*c*.

The third angle θ3 is greater than 0° (θ3>0°). In the present embodiment, the third angle θ3 is an acute angle (0°<θ3<90°).

As shown in FIG. 2, FIG. 3, and FIG. 5, because of what have been described above, the filament coil 5, the first storage groove 31, and the first focusing groove 21 are located closer to the third extension line E3 side than the first reference surface S1. On the other hand, the filament coil 6, the second storage groove 32, and the second focusing groove 22 are located closer to the fifth extension line E5 side than the first reference surface S1.

Figure 6:
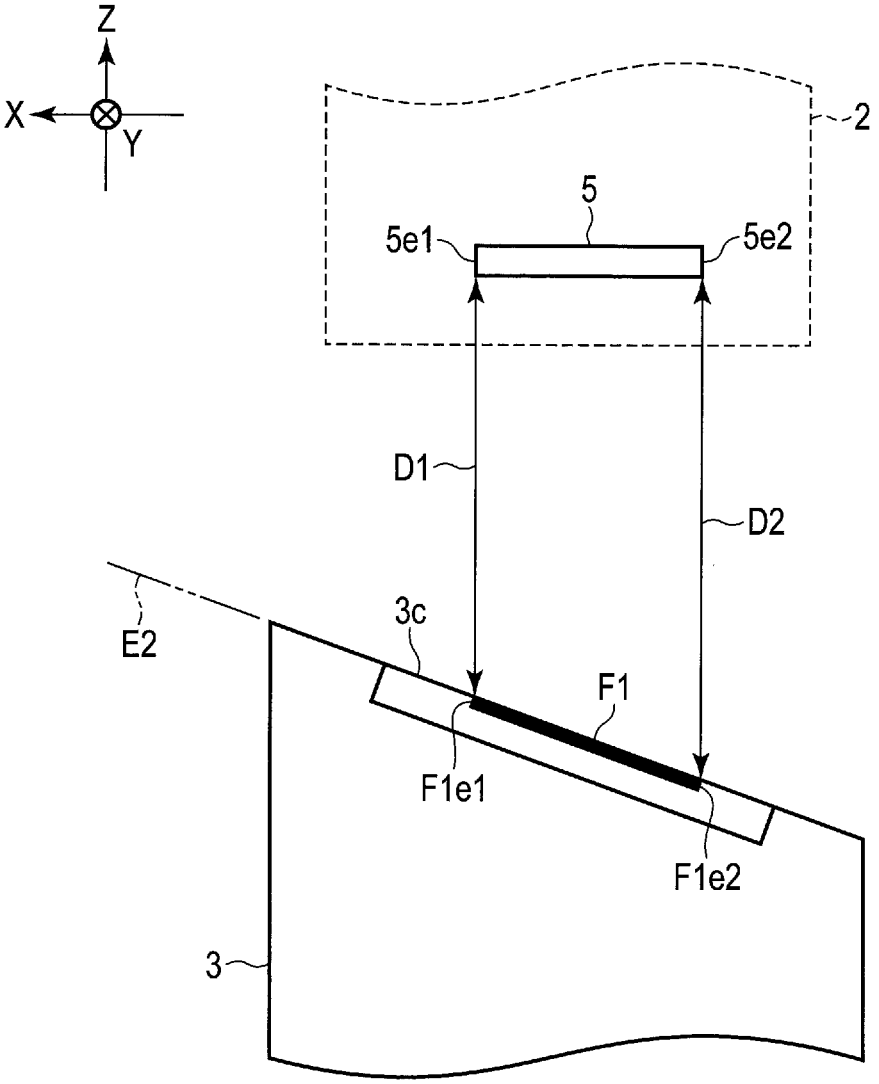
FIG. 6 is a diagram showing the cathode and the anode, and is a diagram for explaining the relationship between a first linear distance and a second linear distance.

FIG. 6 is a diagram showing the cathode 2 and the anode 3, and is a diagram for explaining the relationship between a first linear distance D1 and a second linear distance D2.

As shown in FIG. 6, the linear distance from the one end portion 5*e*1 of the filament coil 5 to one end portion F1*e*1 on the second extension line E2 side of the first focus F1 is the first linear distance D1. The linear distance from the other end portion 5*e*2 of the filament coil 5 to the other end portion F1*e*2 of the first focus F1 is the second linear distance D2. Thus, the first linear distance D1 is less than the second linear distance D2 (D1<D2).

Figure 7:
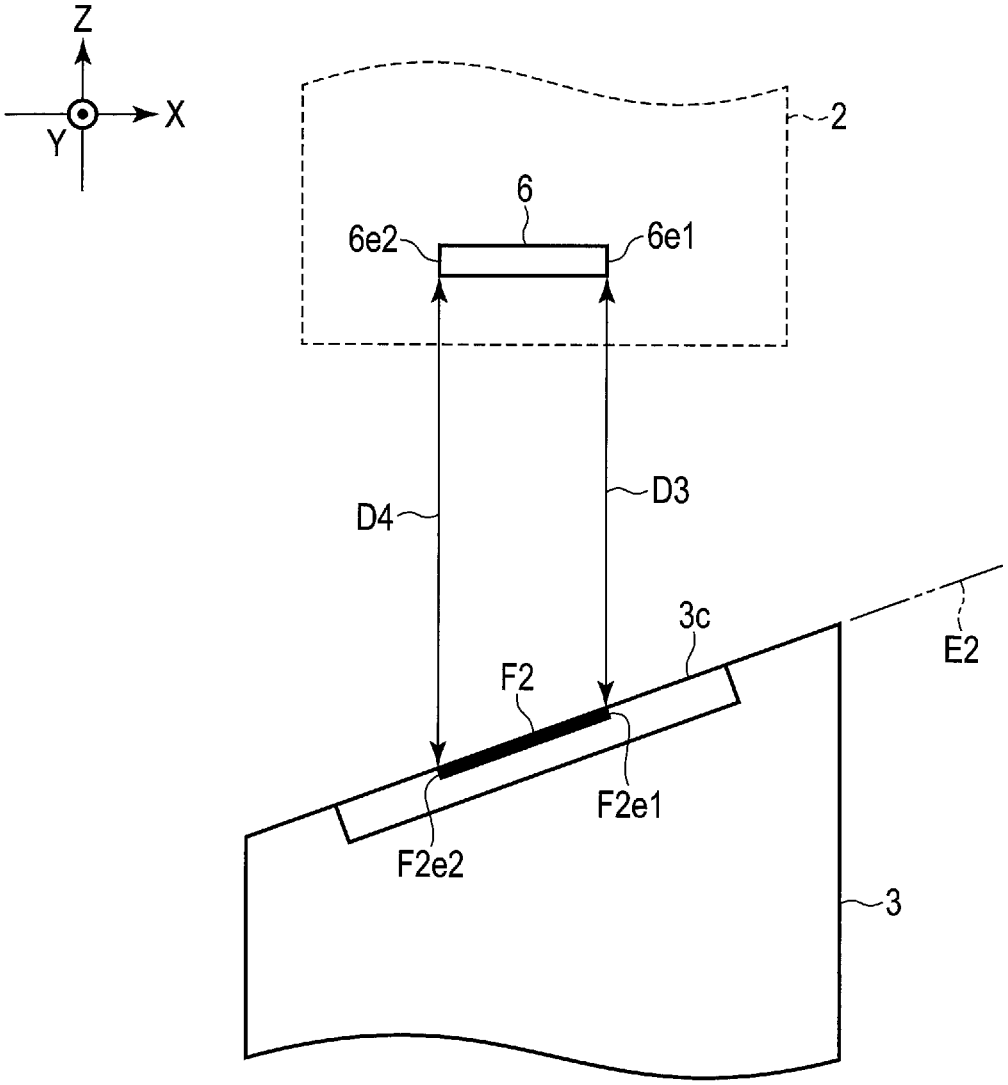
FIG. 7 is a diagram showing the cathode and the anode, and is a diagram for explaining the relationship between a third linear distance and a fourth linear distance.

FIG. 7 is a diagram showing the cathode 2 and the anode 3, and is a diagram for explaining the relationship between a third linear distance D3 and a fourth linear distance D4.

As shown in FIG. 7, the linear distance from the one end portion 6*e*1 of the filament coil 6 to one end portion F2*e*1 on the second extension line E2 side of the second focus F2 is the third linear distance D3. The linear distance from the other end portion 6*e*2 of the filament coil 6 to the other end portion F2*e*2 of the second focus F2 is the fourth linear distance D4. Thus, the third linear distance D3 is less than the fourth linear distance D4 (D3<D4).

Figure 8:
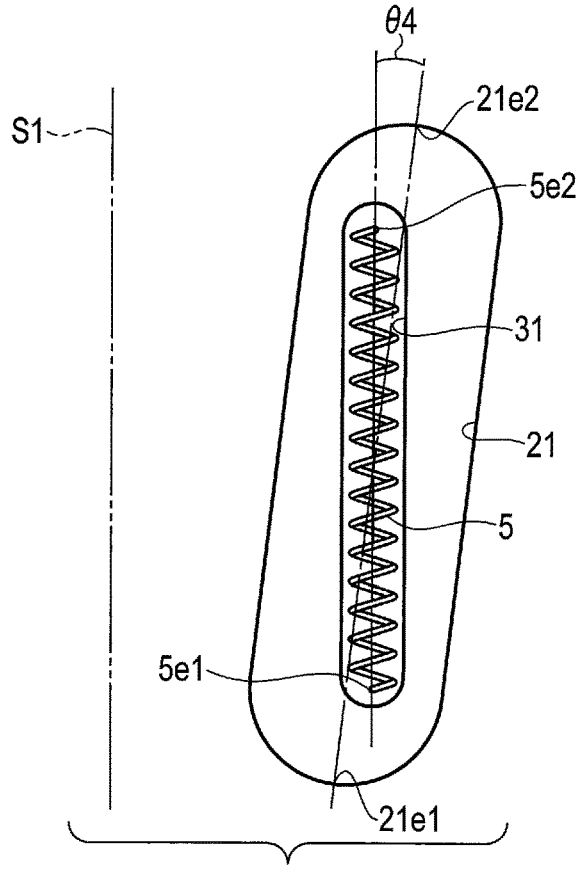
FIG. 8 is a diagram showing a filament coil, a first focusing groove, and a first storage groove, orthogonally projected on a virtual plane parallel to a first inclined plane of the embodiment.

FIG. 8 is a diagram showing the filament coil 5, the first focusing groove 21, and the first storage groove 31, orthogonally projected on a virtual plane parallel to the first inclined plane 11.

As shown in FIG. 8, the longitudinal axis of the first focusing groove 21 is inclined with respect to the longitudinal axis of the first storage groove 31. The longitudinal axis of the filament coil 5 is parallel to the longitudinal axis of the first storage groove 31. In addition, as described above, the one end portion 21*e*1 of the first focusing groove 21 is closer to the first reference surface S1 than the other end portion 21*e*2 of the first focusing groove 21.

Here, in the orthographic projection view of FIG. 8, an angle at which the longitudinal axis of the first focusing groove 21 and the longitudinal axis of the first storage groove 31 (filament coil 5) cross is referred to as a fourth angle θ4. In the present embodiment, the fourth angle θ4 is an acute angle) (0°<θ4<90°).

Figure 9:
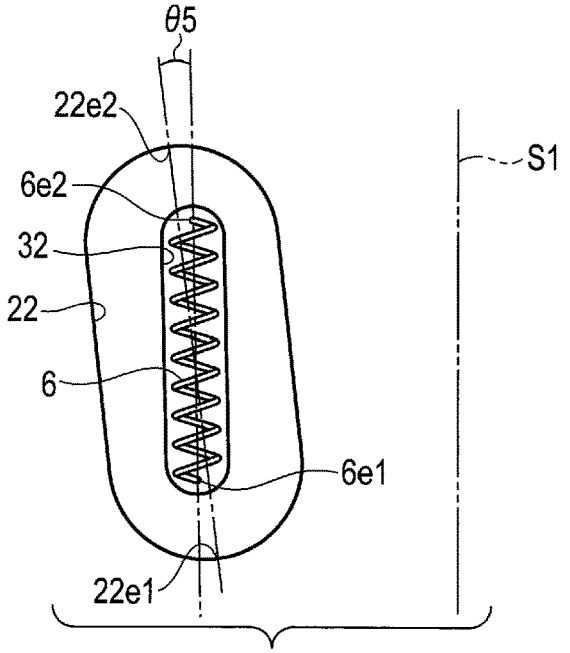
FIG. 9 is a diagram showing a filament coil, a second focusing groove, and a second storage groove, orthogonally projected on a virtual plane parallel to a second inclined plane of the embodiment.

FIG. 9 is a diagram showing the filament coil 6, the second focusing groove 22, and the second storage groove 32, orthogonally projected on a virtual plane parallel to the second inclined plane 12.

As shown in FIG. 9, the longitudinal axis of the second focusing groove 22 is inclined with respect to the longitudinal axis of the second storage groove 32. The longitudinal axis of the filament coil 6 is parallel to the longitudinal axis of the second storage groove 32. In addition, as described above, the one end portion 22*e*1 of the second focusing groove 22 is closer to the first reference surface S1 than the other end portion 22*e*2 of the second focusing groove 22.

Here, in the orthographic projection view of FIG. 9, an angle at which the longitudinal axis of the second focusing groove 22 and the longitudinal axis of the second storage groove 32 (filament coil 6) cross is referred to as a fifth angle θ5. In the present embodiment, the fifth angle θ5 is an acute angle) (0°<θ5<90°).

Figure 10:
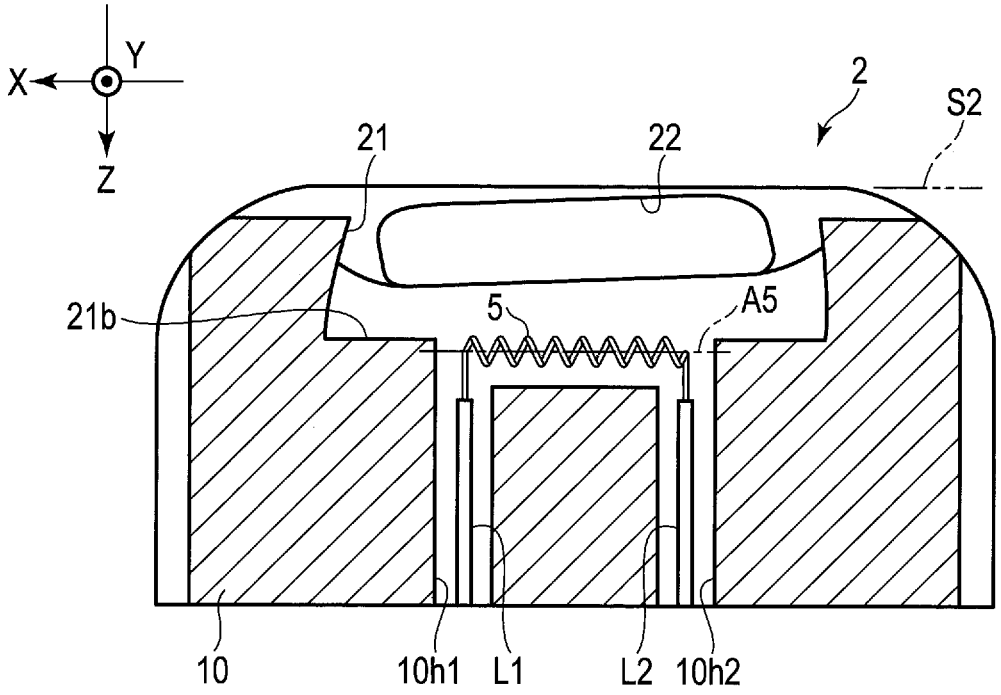
FIG. 10 is a cross-sectional view showing the cathode along line X-X of FIG. 3.

FIG. 10 is a cross-sectional view showing the cathode 2 along line X-X of FIG. 3. As shown in FIG. 10, this figure is also a cross section along an axis A5 along which the filament coil 5 extends. The axis A5 is parallel to the bottom surface 21*b* of the first focusing groove 21. This is because focuses are focused within a predetermined width. In FIG. 10, the bottom surface 21*b* of the first focusing groove 21 is parallel to the second reference surface S2.

Filament legs L1 and L2 are connected to both ends of the filament coil 5. The filament legs L1 and L2 support the filament coil 5. The filament legs L1 and L2 extend along the Z-axis. Thus, each of the filament legs L1 and L2 is perpendicular to the axis A5.

Here, an aggregation of the filament coil 5 and the filament legs L1 and L2 is referred to as a filament aggregation. In a general filament aggregation, each of the filament legs L1 and L2 is held perpendicular to the axis A5. Thus, in the present embodiment, the general filament aggregation can be used as it is.

In the focusing electrode 10, holes 10*h*1 and 10*h*2 for allowing the filament legs L1 and L2 to pass therethrough are formed. The holes 10*h*1 and 10*h*2 extend along the Z-axis as in the case of the filament legs L1 and L2. When a boring process for the holes 10*h*1 and 10*h*2 is carried out, holes do not need to be bored in a direction inclined with respect to the Z-axis. Thus, there is no need to position an angular direction, costing additional time for arrangement.

In addition, what have been described above regarding the filament coil 5, etc., are also similarly applicable to the filament coil 6, etc.

The X-ray tube 1 according to the above-described one embodiment comprises the cathode 2 and the anode 3. The cathode 2 comprises the filament coil 5 and the focusing electrode 10 including the front surface 10A, the first inclined plane 11, the first focusing groove 21, and the first storage groove 31. The anode 3 has the target surface 3*c*.

The first angle θ1 is greater than 0° (θ1>0°), and the second angle θ2 is greater than 0° (θ2>0°). The filament coil 5, the first storage groove 31, and the first focusing groove 21 are located closer to the third extension line E3 side than the first reference surface S1. The first storage groove 31 is not inclined with respect to the main emission direction d, and the first focusing groove 21 is inclined with respect to the main emission direction d. In addition, the one end portion 21*e*1 on the first extension line E1 side of the first focusing groove 21 is closer to the first reference surface S1 than the other end portion 21*e*2 of the first focusing groove 21.

A distortion of the shape of the first focus F1 thereby can be corrected. That is, the distortion of the shape of the first focus F1 can be suppressed, as compared to that in the case where the fourth angle θ4 is 0°. From what have been described above, the X-ray tube 1, which can reduce a distortion of the shape of a focus, can be obtained.

Figure 13:
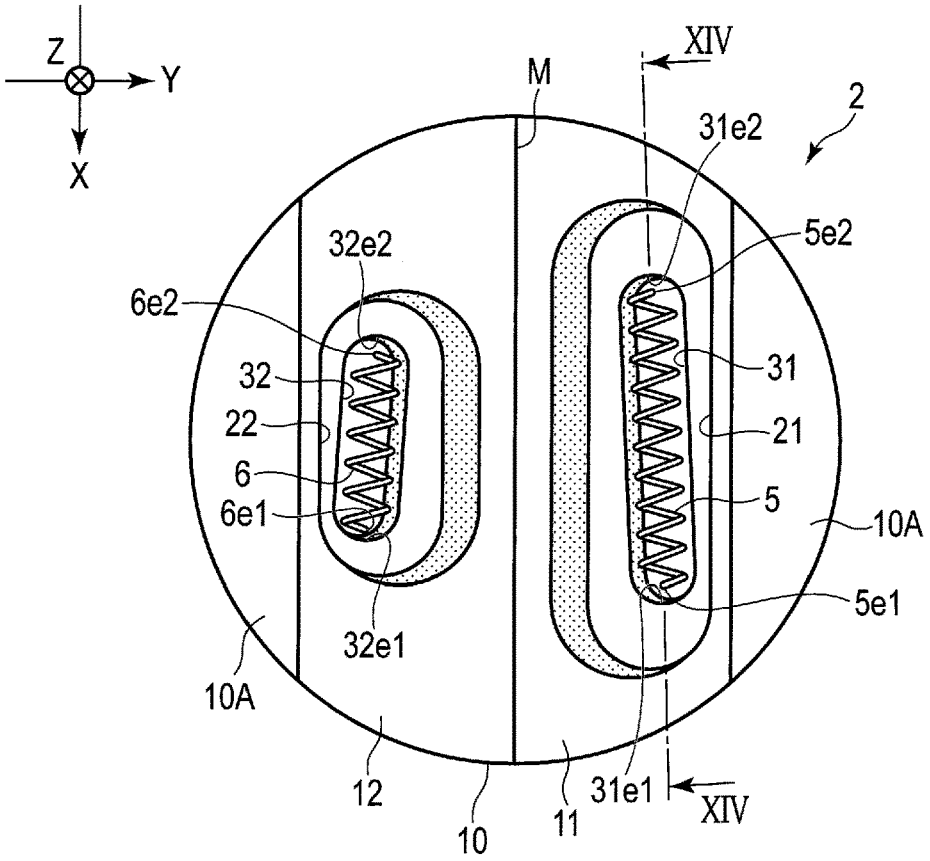
FIG. 13 is a plan view showing a cathode of an X-ray tube according to a comparative example of the embodiment.

Next, an X-ray tube of a comparative example will be described for comparison with the X-ray tube 1 according to the above-described embodiment. FIG. 13 is a plan view showing a cathode 2 of the X-ray tube 1 according to the comparative example of the above-described embodiment.

As shown in FIG. 13, a first focusing groove 21 and a second focusing groove 22 extend parallel to the X-axis. A filament coil 5 and a first storage groove 31 extend in one direction inclined with respect to the X-axis. In addition, a filament coil 6 and a second storage groove 32 extend in another direction inclined with respect to the X-axis. In the above points, the X-ray tube according to the comparative example is broadly different from the X-ray tube 1 according to the above-described embodiment.

Figure 14:
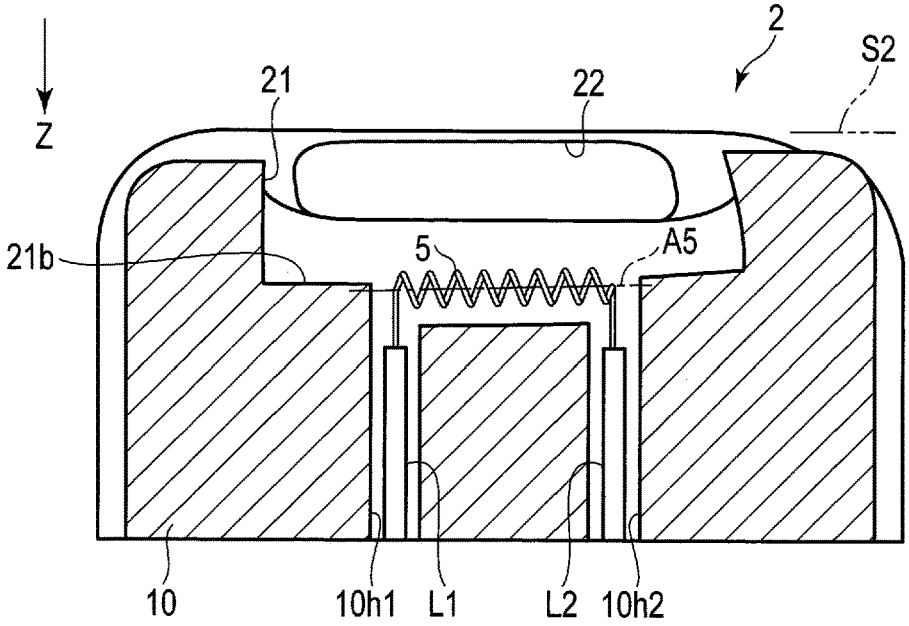
FIG. 14 is a cross-sectional view showing the cathode along line XIV-XIV of FIG. 13.

FIG. 14 is a cross-sectional view showing the cathode along line XIV-XIV of FIG. 13. As shown in FIG. 14, the axis A5 of the filament coil 5 is parallel to a bottom surface 21*b* of the first focusing groove 21. However, in FIG. 14, the bottom surface 21*b* of the first focusing groove 21 is not parallel to a second reference surface S2.

Filament legs L1 and L2 extend along the Z-axis. In addition, holes 10*h*1 and 10*h*2 also extend along the Z-axis. Thus, each of the filament legs L1 and L2 is inclined at an angle other than 90° with respect to the axis A5. Thus, in the present comparative example, it is hard to use a general filament aggregation as it is. In the present comparative example, a filament aggregation needs to be newly prepared in consideration of the respective angles of inclination of the filament legs L1 and L2 with respect to the axis A5.

Moreover, in the present comparative example, the above-described general filament aggregation can be used by adjusting the direction in which the holes 10*h*1 and 10*h*2 extend. However, the positioning of an angular direction is necessary for a process of boring a focusing electrode 10. Thus, the necessity to position an angular direction, costing additional time for arrangement, arises.

In the above-described comparative example, what have been described regarding the filament coil 5, etc., are also similarly applicable to the filament coil 6, etc.

Figure 15:
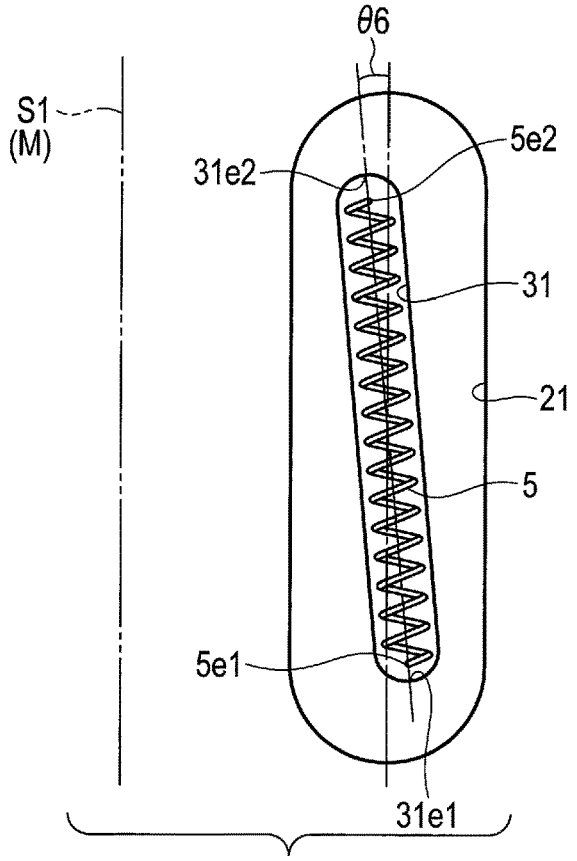
FIG. 15 is a diagram showing a filament coil, a first focusing groove, and a first storage groove, orthogonally projected on a virtual plane parallel to a first inclined plane in the comparative example.

FIG. 15 is a diagram showing the filament coil 5, the first focusing groove 21, and the first storage groove 31, orthogonally projected on a virtual plane parallel to a first inclined plane 11 in the above-described comparative example.

As shown in FIG. 15, the longitudinal axis of the first storage groove 31 is inclined with respect to the longitudinal axis (valley bottom portion M) of the first focusing groove 21. The longitudinal axis of the filament coil 5 is parallel to the longitudinal axis of the first storage groove 31. In addition, the other end portion 31*e*2 of the first storage groove 31 is closer to a first reference surface S1 than one end portion 31*e*1 of the first storage groove 31.

Here, in the orthographic projection view of FIG. 15, an angle at which the longitudinal axis of the first focusing groove 21 and the longitudinal axis of the first storage groove 31 (filament coil 5) cross each other is referred to as a sixth angle θ6. In the present comparative example, the sixth angle θ6 is an acute angle (0°<θ6<90°).

Figure 16:
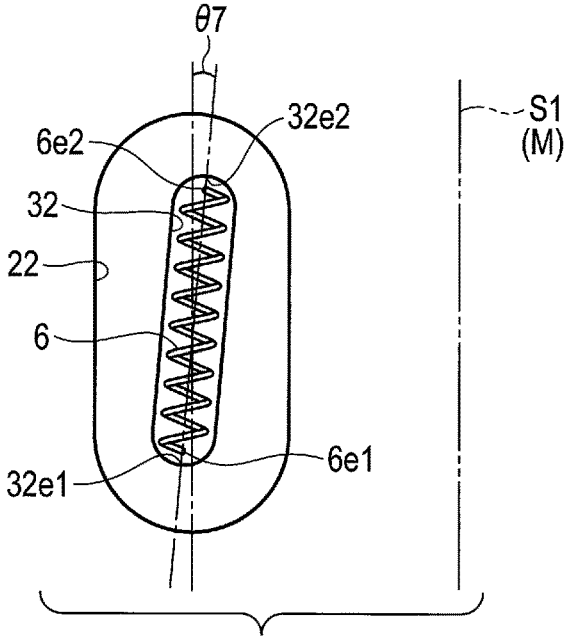
FIG. 16 is a diagram showing a filament coil, a second focusing groove, and a second storage groove, orthogonally projected on a virtual plane parallel to a second inclined plane in the comparative example.

FIG. 16 is a diagram showing the filament coil 6, the second focusing groove 22, and the second storage groove 32, orthogonally projected on a virtual plane parallel to a second inclined plane 12 in the above-described comparative example.

As shown in FIG. 16, the longitudinal axis of the second storage groove 32 is inclined with respect to the longitudinal axis (valley bottom portion M) of the second focusing groove 22. The longitudinal axis of the filament coil 6 is parallel to the longitudinal axis of the second storage groove 32. In addition, as described above, the other end portion 32*e*2 of the second storage groove 32 is closer to the first reference surface S1 than one end portion 32*e*1 of the second storage groove 32.

Here, in the orthographic projection view of FIG. 16, an angle at which the longitudinal axis of the second focusing groove 22 and the longitudinal axis of the second storage groove 32 (filament coil 6) cross each other is referred to as a seventh angle θ7. In the present comparative example, the seventh angle θ7 is an acute angle (0°<θ7<90°).

While certain embodiments and modified example have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, FIG. 8 of the above-described embodiment shows the case where the first storage groove 31 and the filament coil 5 are not inclined and FIG. 9 shows the case where the second storage groove 32 and the filament coil 6 are not inclined, but the embodiment is not limited to these cases.

Figure 11:
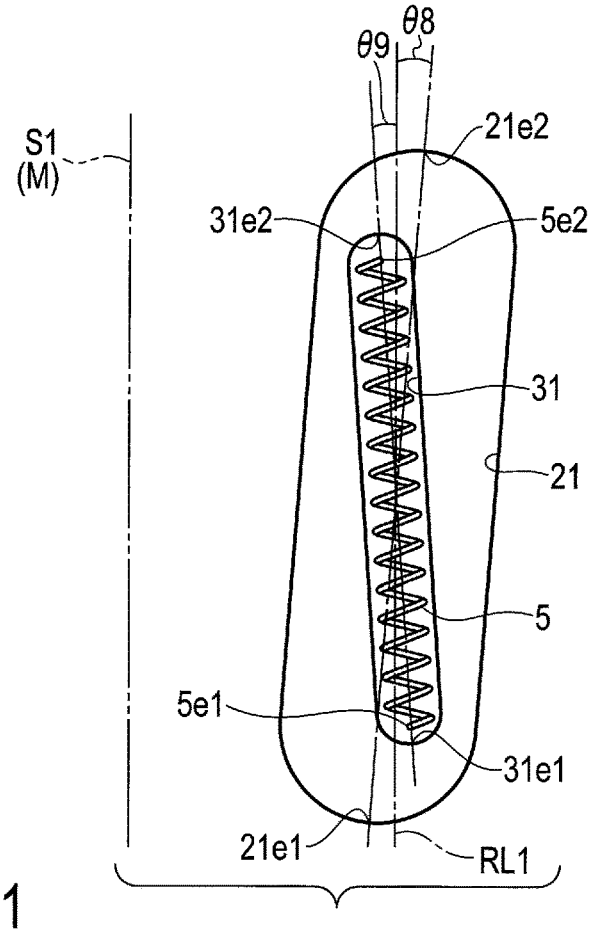
FIG. 11 is a diagram showing the filament coil, the first focusing groove, and the first storage groove, orthogonally projected on a virtual plane parallel to the first inclined plane in a modified example of the embodiment.

As shown in FIG. 11, not only the first focusing groove 21 but also the filament coil 5 and the first storage groove 31 may be inclined. In this case, the other end portion 31*e*2 of the first storage groove 31 is closer to the first reference surface S1 than the one end portion 31*e*1 of the first storage groove 31. With respect to a reference line RL1 parallel to the first reference surface S1 (valley bottom portion M), an angle formed by the longitudinal axis of the first focusing groove 21 is an eighth angle θ8, and an angle formed by the longitudinal axis of the first storage groove 31 is a ninth angle θ9. When compared to that of FIG. 8, the eighth angle θ8 is less than the fourth angle θ4 (θ8<θ4), and when compared to that of FIG. 15, the ninth angle θ9 is less than the sixth angle θ6 (θ9<θ6).

Figure 12:
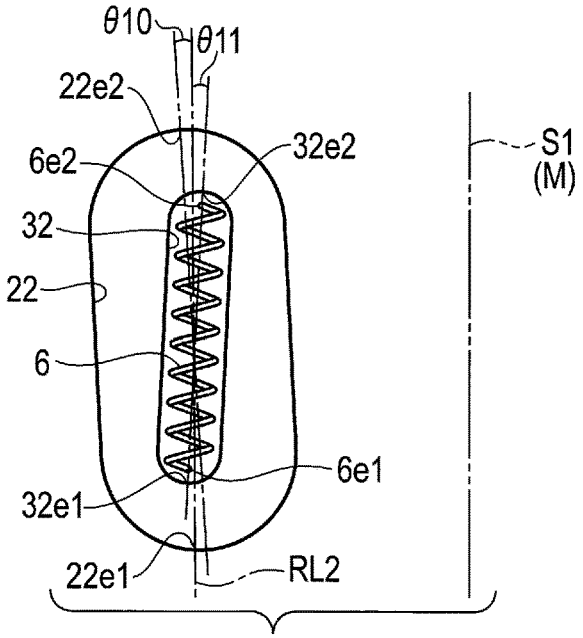
FIG. 12 is a diagram showing the filament coil, the second focusing groove, and the second storage groove, orthogonally projected on a virtual plane parallel to the second inclined plane in the modified example.

As shown in FIG. 12, not only the second focusing groove 22 but also the filament coil 6 and the second storage groove 32 may be inclined. In this case, the other end portion 32*e*2 of the second storage groove 32 is closer to the first reference surface S1 than the one end portion 32*e*1 of the second storage groove 32. With respect to a reference line RL2 parallel to the first reference surface S1 (valley bottom portion M), an angle formed by the longitudinal axis of the second focusing groove 22 is a tenth angle θ10, and an angle formed by the longitudinal axis of the second storage groove 32 is an eleventh angle θ11. When compared to that of FIG. 9, the tenth angle θ10 is less than the fifth angle θ5 (θ10<θ5), and when compared to that of FIG. 16, the eleventh angle θ11 is less than the seventh angle θ7 (θ11<θ7).

In a case where the X-ray tube 1 comprises a plurality of electron guns, it suffices if a focusing groove of at least one electron gun of the X-ray tube 1 is inclined as shown in FIG.

8, FIG. 9, FIG. 11, and FIG. 12. Thus, the X-ray tube 1 may comprise an electron gun including a focusing groove, a storage groove, and a filament coil, none of which are inclined.

In addition, while the case where the valley bottom portion M is linear has been illustrated in the above-described embodiment, the valley bottom portion M may be a flat surface perpendicular to the first reference surface S1. In this case, the cathode 2 may comprise another electron gun in the flat valley bottom portion M.

Moreover, while the case where the focusing electrode 10 has the flat front surface 10A has been described in the above-described embodiment, the flat front surface 10A may not exist.

The embodiments of the present invention are not limited to the above-described stationary anode X-ray tube 1, and can be applied to various types of stationary anode X-ray tubes, a rotation anode type X-ray tubes, or other X-ray tubes.

What is claimed is:

1. An X-ray tube comprising:

an anode comprising a target surface which emits an X-ray in a main emission direction from a first focus formed by collision of an electron beam; and a cathode disposed opposite the target surface of the anode, the cathode comprising a first filament which emits the electron beam and a focusing electrode which focuses the electron beam emitted from the first filament, the focusing electrode including a valley bottom portion located farthest from the first focus, a first inclined plane sloping up from the valley bottom portion in a direction of the anode, a first focusing groove opening in the first inclined plane, and a first storage groove opening in a bottom surface of the first focusing groove and storing the first filament, wherein:

when an axis passing through a center of the first focus and parallel to an axis of the X-ray tube is a reference axis, a plane including the reference axis and the main emission direction is a first reference surface, and a first angle formed by a first extension line and a second extension line crossing each other on an opposite side to a side to which the X-ray is emitted with respect to the reference axis is θ1, the first extension line being a virtual straight line extending from a boundary between the valley bottom portion and the first inclined plane along the first reference surface, the second extension line being a virtual straight line extending from the target surface along the first reference surface and the target surface, $\theta 1 > 0°$;

the first focusing groove has a longitudinal axis;

one end portion on the first extension line side of the first focusing groove is closer to the first reference surface than the other end portion of the first focusing groove; and the first storage groove has a longitudinal axis orthogonal to the reference axis and parallel to the first reference surface.

2. The X-ray tube of claim 1, wherein the valley bottom portion is a segment parallel to the first reference surface.

3. The X-ray tube of claim 1, wherein the valley bottom portion is a flat surface perpendicular to the first reference surface.

4. The X-ray tube of claim 1, wherein the first filament has a longitudinal axis, and when a first linear distance from one end portion on the first extension line side of the first filament to one end portion on the second extension line side of the first focus is D1, and a second linear distance from the other end portion of the first filament to the other end portion of the first focus is D2, $D1 < D2$.

5. The X-ray tube of claim 1, wherein the longitudinal axis of the first focusing groove is inclined with respect to the longitudinal axis of the first storage groove.

6. The X-ray tube of claim 1, wherein the first filament has a longitudinal axis parallel to the longitudinal axis of the first storage groove.

7. The X-ray tube of claim 1, wherein the first inclined plane has a first edge located on the valley bottom portion side and a second edge located opposite the valley bottom portion, and is uniformly inclined from the first edge toward the second edge.

* * * * *